US009889336B1

(12) United States Patent
Chen

(10) Patent No.: US 9,889,336 B1
(45) Date of Patent: Feb. 13, 2018

(54) CHAIN WHEEL LOCKING ASSEMBLY OF AN EXERCISE APPARATUS

(71) Applicant: Ya-Chi Chen, New Taipei (TW)

(72) Inventor: Ya-Chi Chen, New Taipei (TW)

( * ) Notice: Subject to any disclaimer, the term of this patent is extended or adjusted under 35 U.S.C. 154(b) by 5 days.

(21) Appl. No.: 15/293,978

(22) Filed: Oct. 14, 2016

(51) Int. Cl.

| | |
|---|---|
| ***A63B 22/06*** | (2006.01) |
| ***A63B 24/00*** | (2006.01) |
| ***A63B 23/035*** | (2006.01) |
| ***A63B 23/04*** | (2006.01) |
| ***A63B 23/12*** | (2006.01) |

(52) U.S. Cl.
CPC .... *A63B 22/0605* (2013.01); *A63B 23/03525* (2013.01); *A63B 23/04* (2013.01); *A63B 23/12* (2013.01); *A63B 24/00* (2013.01); *A63B 2022/0617* (2013.01); *A63B 2022/0635* (2013.01)

(58) Field of Classification Search
CPC ..... A63B 22/0605; A63B 23/03525; A63B 23/04; A63B 23/12; A63B 24/00; A63B 2022/0617; A63B 2022/0635
See application file for complete search history.

(56) References Cited

U.S. PATENT DOCUMENTS 4,789,153 A * 12/1988 Brown ..... A63B 21/0088 482/111
5,221,236 A * 6/1993 Raymer ..... B62M 9/16 474/109
5,480,366 A * 1/1996 Harnden ..... A63B 69/16 482/57
6,234,939 B1 * 5/2001 Moser ..... A63B 22/0007 482/57
6,821,236 B2 * 11/2004 Liang ..... A63B 21/00 482/114
7,029,424 B2 * 4/2006 Chen ..... A63B 21/015 482/63
7,413,530 B2 * 8/2008 Warner ..... A63B 21/157 482/57
7,488,275 B2 * 2/2009 Warner ..... A63B 21/157 482/57
7,740,565 B2 * 6/2010 Chen ..... A63B 21/005 482/57
2003/0153436 A1 * 8/2003 Ho ..... A63B 21/00178 482/63
2016/0051881 A1 * 2/2016 Colan ..... A63B 69/16 482/61

* cited by examiner

*Primary Examiner* — Andrew S Lo
(74) *Attorney, Agent, or Firm* — Egbert Law Offices, PLLC

(57) ABSTRACT

A chain wheel locking device of an exercise apparatus includes a wheel frame mounted on a main frame of the exercise apparatus, wherein the wheel frame is a U-shaped structure and has two supports corresponding to each other. The exercise apparatus includes a chain wheel axle rotatably extending through a chain wheel and the two supports. The chain wheel axle has two opposite ends each having a locking device mounted thereon for positioning the chain wheel axle and preventing the chain wheel axle from being moved relative to the wheel frame such that a tension of a chain on the chain wheel is maintained to prevent the chain from being detached from the chain wheel.

6 Claims, 7 Drawing Sheets

CHAIN WHEEL LOCKING ASSEMBLY OF AN EXERCISE APPARATUS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a chain wheel locking assembly, and more particularly to a chain wheel locking device of an exercise apparatus.

2. Description of Related Art Including Information Disclosed Under 37 CFR 1.97 and 37 CFR 1.98

There are various exercise devices in the market, such as an exercise bike, a stepper, a rowing machine, a treadmill and a tension machine. The structure of the exercise bike is in the field of the present invention.

A conventional exercise bike is usually provided with a drive wheel connected to a crank device. The drive wheel is operated with a driven wheel via a belt or a chain, wherein the driven wheel is connected to a damping device for promoting the exercise effect. As usual, an axle of the drive wheel is horizontally disposed on a frame of the exercise bike such that the frame needs to horizontally define a slot for mounting the axle with the drive wheel. The axle is positioned when the tension of the belt or the chain is completely adjusted by nuts. However, the nuts may be loosed relative to the vibrations due to a continual operation. As a result, the tension and the transmission effect of the belt of the chain are reduced. In the course of time, the belt or the chain may detach from the drive/driven wheel and the exercise bike loses its original function.

The present invention has arisen to mitigate and/or obviate the disadvantages of the conventional positioning method of the wheel axle of the exercise apparatus.

BRIEF SUMMARY OF THE INVENTION

The main objective of the present invention is to provide an improved chain wheel locking device of an exercise apparatus, which is provided to prevent the chain wheel axle from being moved relative to the wheel frame such that a tension of a chain on the chain wheel is maintained to prevent the chain from being detached from the chain wheel.

To achieve the objective, the chain wheel locking device of an exercise apparatus in accordance with the present invention comprises a wheel frame adapted to be mounted on a main frame of the exercise apparatus, wherein the wheel frame is a U-shaped structure and has two supports corresponding to each other. The exercise apparatus includes a chain wheel axle rotatably extending through a chain wheel and the two supports. The chain wheel axle has two opposite ends each having a locking device mounted thereon for positioning the chain wheel axle and preventing the chain wheel axle from being moved relative to the wheel frame such that a tension of a chain on the chain wheel is maintained to prevent the chain from being detached from the chain wheel. Each support includes a top portion having a slot defined therein and the slot is adapted to allow the chain wheel axle extending through the two supports. The locking device includes a pulling member adapted to be sleeved on the chain wheel axle for adjusting a tension of the chain of the exercise apparatus and a locking adapted to be sleeved on the chain wheel axle for tightly positioning the pulling member after adjusting the tension of the chain.

Further benefits and advantages of the present invention will become apparent after a careful reading of the detailed description with appropriate reference to the accompanying drawings.

DETAILED DESCRIPTION OF THE INVENTION

Figure 1:
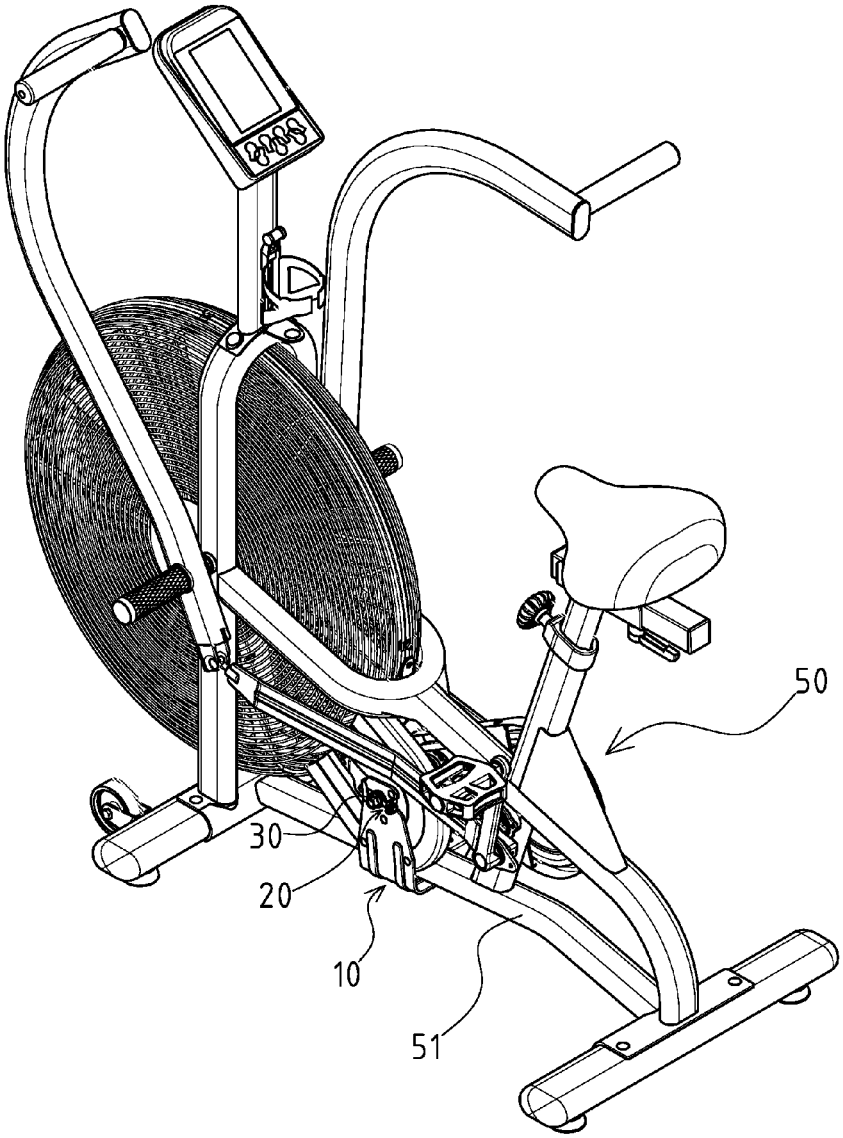
FIG. 1 is a perspective view of a chain wheel locking assembly of an exercise apparatus in accordance with the present invention.
Figure 2:
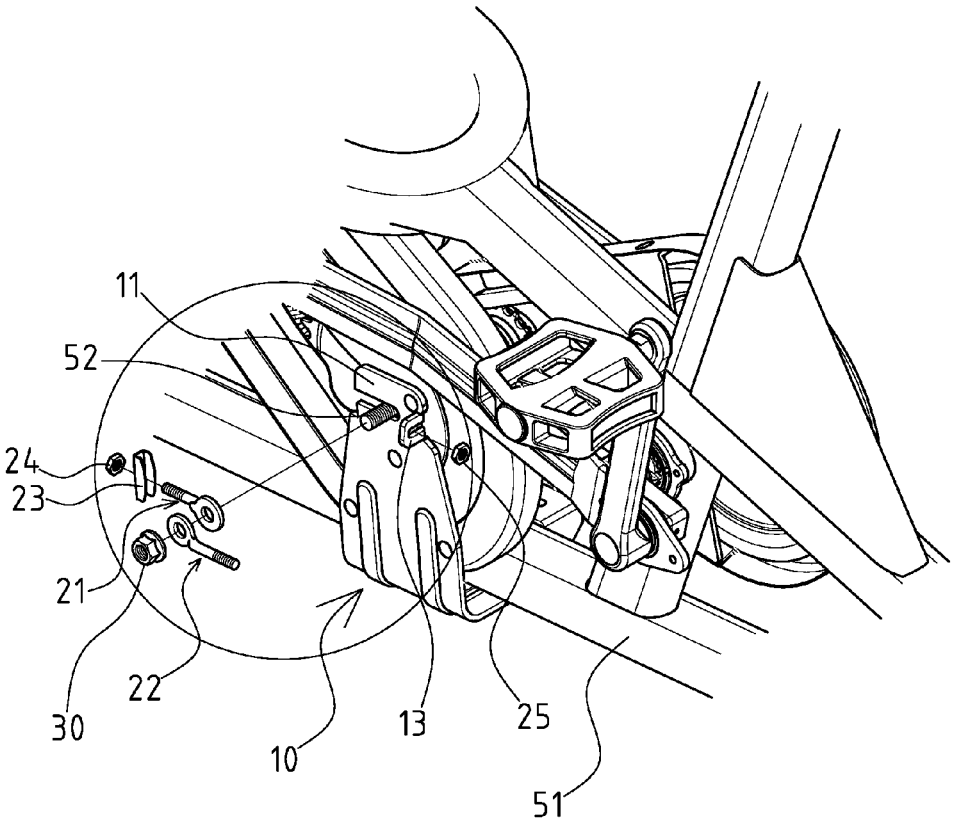
FIG. 2 is a partially enlarged view of FIG. 1, wherein the chain wheel locking assembly is exploded.
Figure 3:
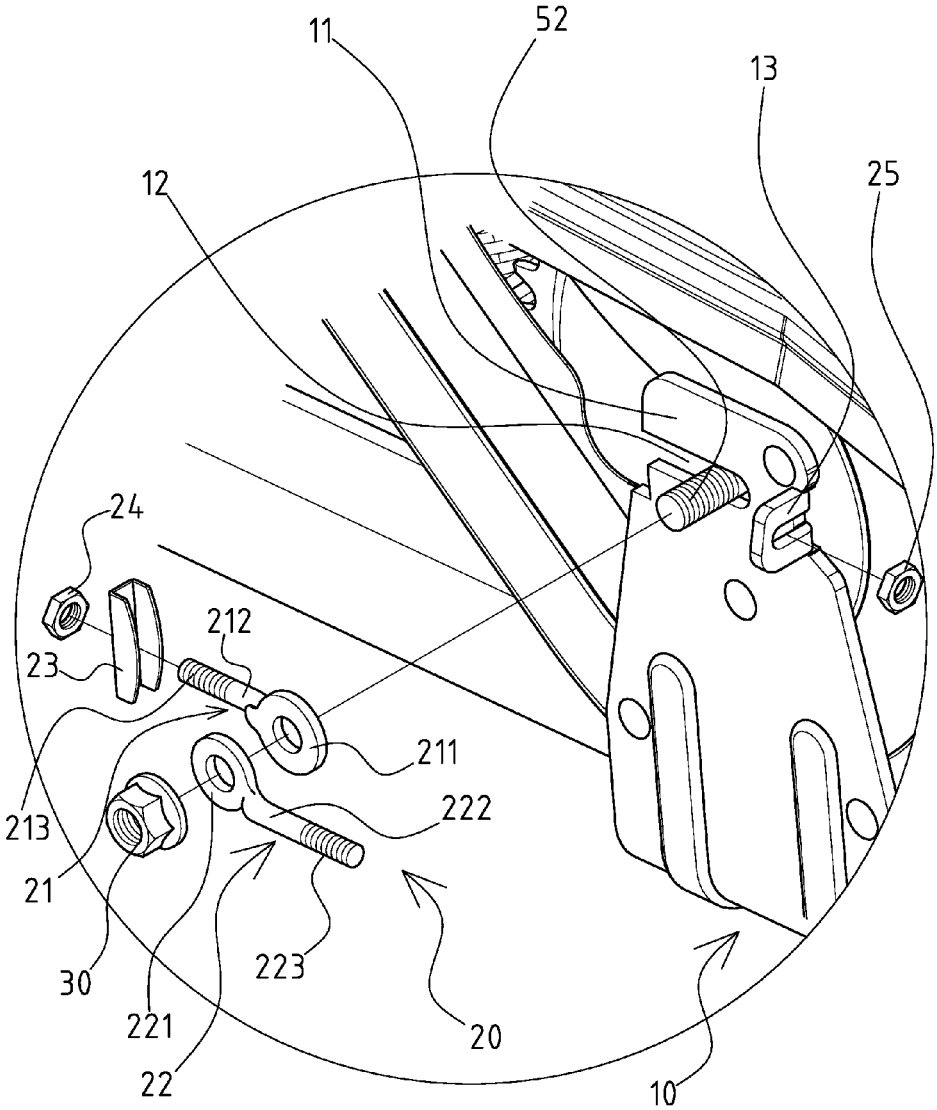
FIG. 3 is a partially enlarged view of FIG. 2.

Referring to the drawings and initially to FIGS. 1-3, a chain wheel locking assembly of an exercise apparatus 50 in accordance with the present invention comprises a wheel frame 10 adapted to be mounted on a main frame 51 of the exercise apparatus 50, wherein the wheel frame 10 is a U-shaped structure and has two support 11 corresponding to each other. The exercise apparatus 50 includes a chain wheel axle 52 rotatably extending through a chain wheel and the two supports 11. The chain wheel axle 52 has two opposite ends each having a locking device 20 mounted thereon for positioning the chain wheel axle 52 and preventing the chain wheel axle 52 from being moved relative to the wheel frame 10 such that a tension of a chain on the chain wheel is maintained to prevent the chain from being detached from the chain wheel.

Each support 11 includes a top portion having a slot 12 defined therein and an ear 13 extending therefrom, wherein the slot 12 and the ear linearly correspond to each other, and the slot 12 is adapted to allow the chain wheel axle 52 extending through the two supports 11. Each locking device 20 includes a pulling member 21 and a locking member 22, wherein the mounting direction of the pulling member 21 is opposite to that of the locking member 22. In the preferred embodiment of the present invention, the pulling member 21 has a structure the same as that of the locking member 22. The pulling member 21 and the locking member 22 respectively include a loop 211/221 and a shaft 212/222 outwardly extending from the loop 211/221, wherein the loop 211/221 are adapted to be sleeved on the chain wheel axle 52 and the shaft 212/222 has a threaded portion 213/223 formed on a free end thereof. A first nut 24 is screwed onto the threaded portion 213 of the shaft 212 of the pulling member 21 after the shaft 212 of the pulling member 21 extending through an engager 23, wherein the engager 23 has a U-shaped cross-section for partially receiving a distal edge of a corresponding one of the two supports 11. A second nut 25 is screwed onto the threaded portion 223 of the shaft 222 of the locking member 22 after shaft 222 of the locking member 22 extending through the ear 13. A nut 30 is adapted to be screwed onto a corresponding one of the two opposite ends of the chain wheel axle 52 to fasten the loop 211/221 of each of the pulling member 21 and the locking member 22 and preventing the pulling member 21 and the locking member 22 from being detached from the chain wheel axle 52.

When using the first preferred embodiment of the chain wheel locking assembly in accordance with the present invention to position the chain wheel axle 52, the first nut 24 and the second nut 25 are firstly rotated to make the engager 23 and the second nut 25 respectively abutting against the distal edge of a corresponding one of the two supports 11 and the ear 13. The position of the chain wheel axle 52 in the slot 12 is adjusted and the tension of the chain is adjusted by rotating the first nut 24 and the second nut 25. The nut 30 is rotated to tightly force the loops 211, 221 of the pulling member 21 and the locking member 22 after the position of the chain wheel axle 52 in the slot 12 is completely adjusted and the tension of the chain is completely adjusted. The tension of the chain may be loosened after being used for a period of time. However, the tension of the chain is renewed after repeating the adjusting steps as described above and the use life of the chain can be lengthened.

Figure 4:
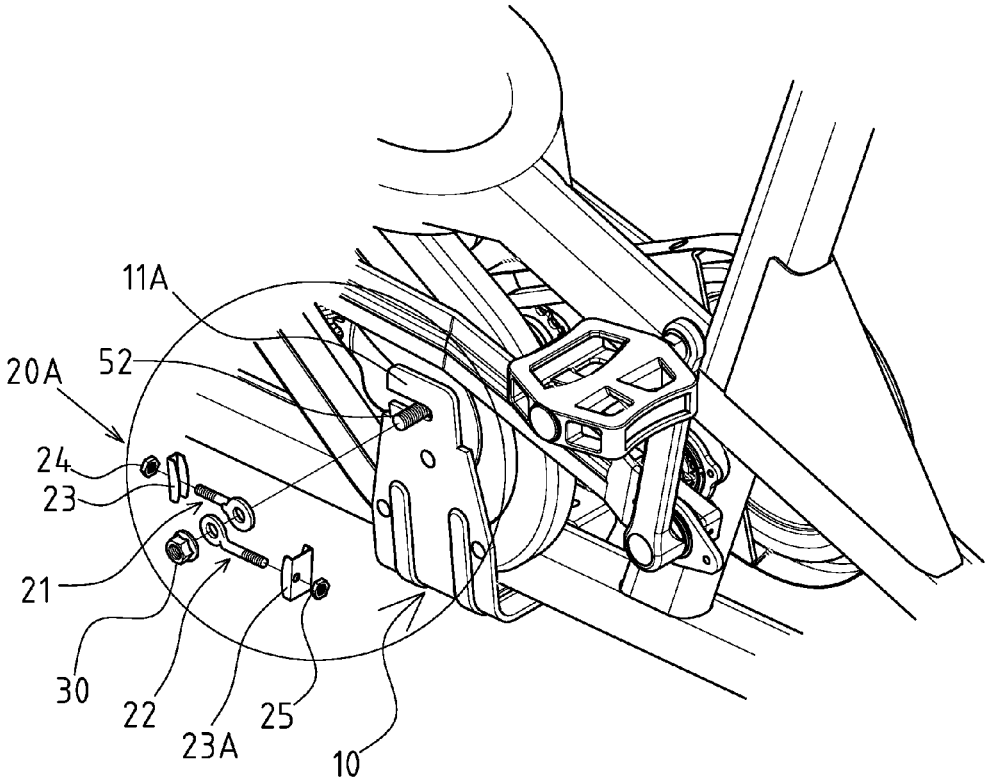
FIG. 4 is an exploded perspective view of a second embodiment of the chain wheel locking assembly in accordance with the present invention.
Figure 5:
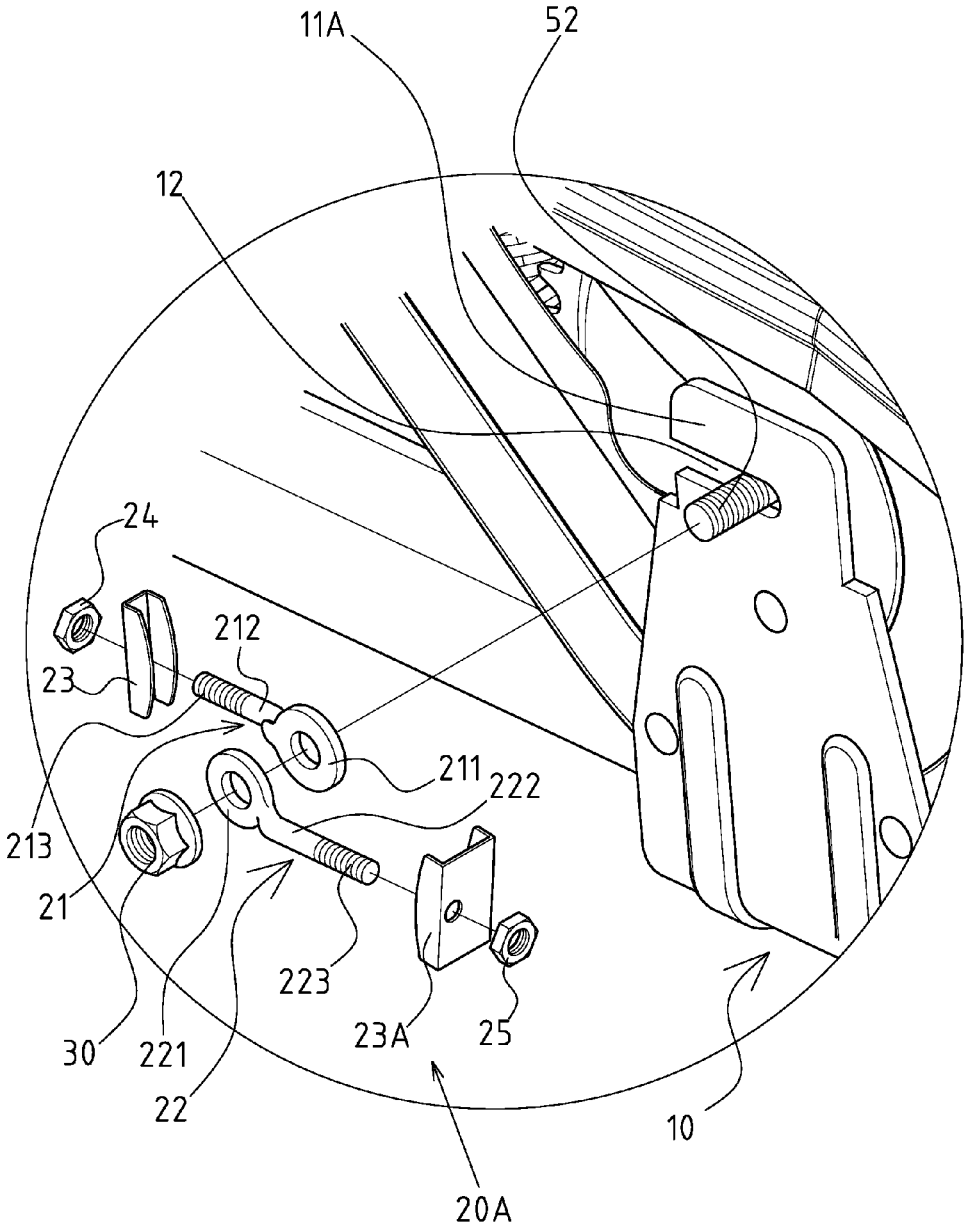
FIG. 5 is a partially enlarged view of FIG. 4.

With reference to FIGS. 4 and 5 that show a second preferred embodiment of the chain wheel locking assembly in accordance with the present invention, in this embodiment, each support 11A only has a slot 12 defined therein and the ear 13 of the first preferred embodiment is disappeared in this embodiment. The locking device 20A includes a first engager 23 and a second engager 23A, wherein the threaded portions 213, 223 of the shafts 212, 222 of the pulling member 21 and the locking member 22 respectively having a first nut 24 and a second nut 25 screwed thereon after the shafts 212, 222 of the pulling member 21 and the locking member 22 respectively extending through the first engager 23 and the second engager 23A. The operated steps of the second preferred embodiment are similar to that of the first preferred embodiment such that the operated steps of the second preferred embodiment are not repeated. The first engager 23 and the second engager 23A respectively have a U-shaped cross-section, wherein the second engager 23A has a width greater than that of the first engager 23.

Figure 6:
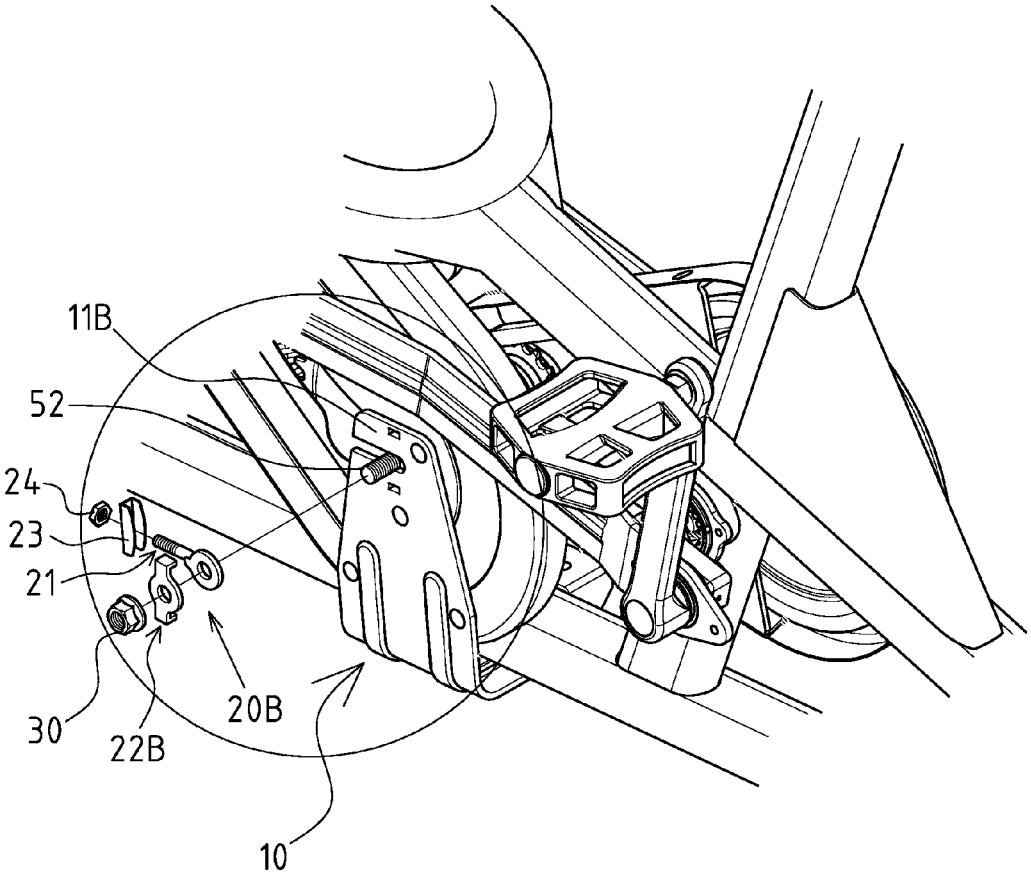
FIG. 6 is an exploded perspective view of a third embodiment of the chain wheel locking assembly in accordance with the present invention.
Figure 7:
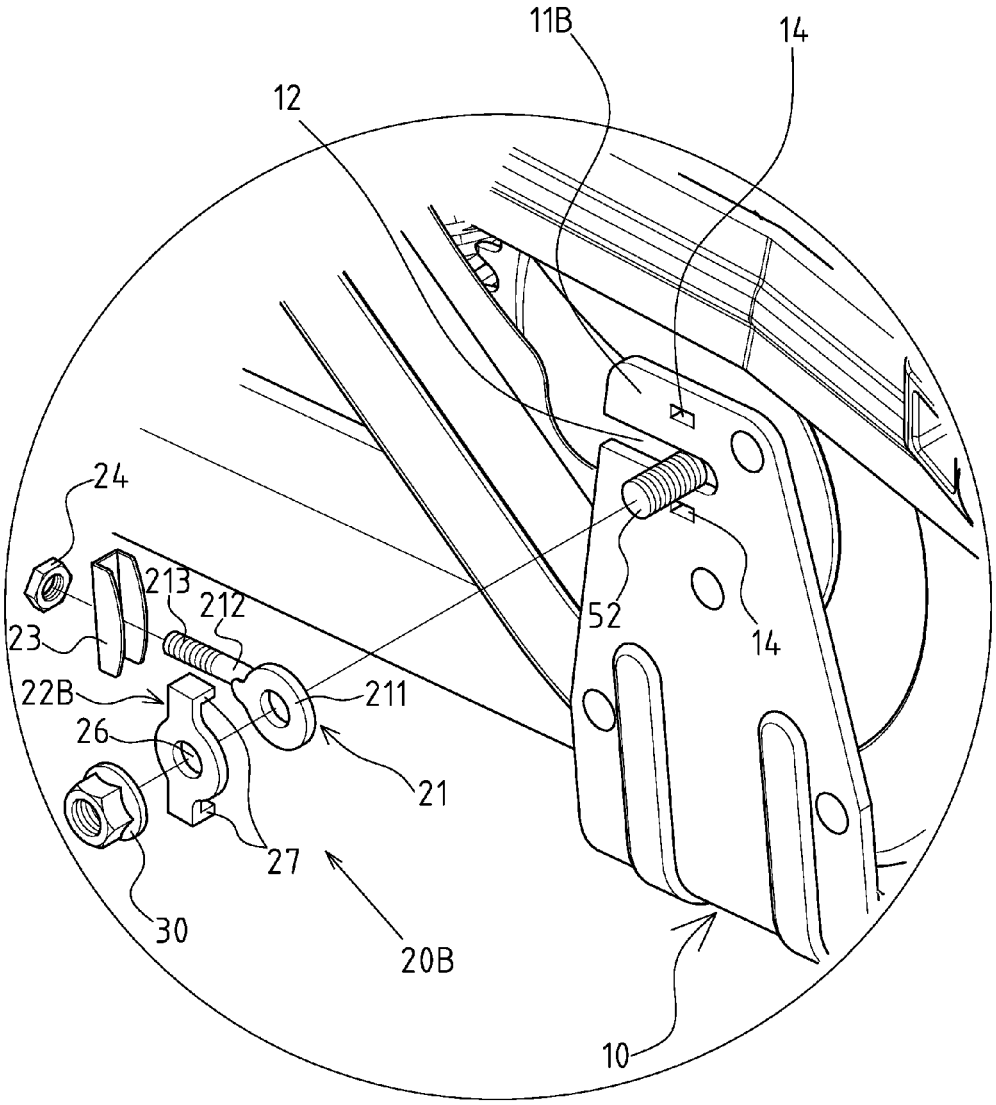
FIG. 7 is a partially enlarged view of FIG. 6.

With reference to FIGS. 6 and 7 that show a third preferred embodiment of the chain wheel locking assembly in accordance with the present invention, in this embodiment, each support 11B only has the slot 12 defined therein and the ear 13 of the first preferred embodiment is disappeared in this embodiment. The slot 12 has two opposite sides each having a bore 14 defined in the support 11B. The locking device 20B includes a pulling member 21 and a locking member 22B. The pulling member 21 includes a loop 211 and a shaft 212 outwardly extending from the loop 211, wherein the loop 211 is adapted to be sleeved on the chain wheel axle 52 and the shaft 212 has a threaded portion 213 formed on a free end thereof. A first nut 24 is screwed onto the threaded portion 213 of the shaft 212 of the pulling member 21 after the shaft 212 of the pulling member 21 extending through an engager 23, wherein the engager 23 has a U-shaped cross-section for partially receiving a distal edge of a corresponding one of the two supports 11. The locking member 22B includes a through hole 26 defined therein and the chain wheel axle 52 extending through the through hole 26. The locking member 22B has two opposite ends each having an insertion 27, wherein each insertion 27 is inserted into a corresponding one of the two bores 14 and a nut 30 is screwed onto the chain wheel axle 52 to tightly position the locking member 22 such that the locking member 22B does not move relative to the support 11B. Accordingly, the chain wheel axle 52 and the chain wheel do not move relative to the support 11B.

Although the invention has been explained in relation to its preferred embodiment, it is to be understood that many other possible modifications and variations can be made without departing from the spirit and scope of the invention as hereinafter claimed.

I claim:

1. A chain wheel locking device of an exercise apparatus, comprising a wheel frame adapted to be mounted on a main frame of the exercise apparatus, wherein the wheel frame is a U-shaped structure and has two supports corresponding to each other, the exercise apparatus including a chain wheel axle rotatably extending through a chain wheel and the two supports, the chain wheel axle having two opposite ends each having a locking device mounted thereon for positioning the chain wheel axle and preventing the chain wheel axle from being moved relative to the wheel frame such that a tension of a chain on the chain wheel is maintained to prevent the chain from being detached from the chain wheel, wherein each support includes a top portion having a slot defined therein, the slot adapted to allow the chain wheel axle to extend through the two supports; and each locking device includes:

a pulling member adapted to be sleeved on the chain wheel axle for adjusting a tension of the chain of the exercise apparatus; and a locking adapted to be sleeved on the chain wheel axle for tightly positioning the pulling member after adjusting the tension of the chain.

2. The chain wheel locking device as claimed in claim 1, wherein each support includes an ear extending from the top portion thereof and linearly corresponding to the slot, the pulling member and the locking member respectively include a loop and a shaft outwardly extending from the loop, wherein the loops are adapted to be sleeved on the chain wheel axle and each shaft has a threaded portion formed on a free end thereof, a first nut screwed onto the threaded portion of the shaft of the pulling member after the shaft of the pulling member extends through an engager, a second nut screwed onto the threaded portion of the shaft of the locking member after the shaft of the locking member extends through the ear, a nut adapted to be screwed onto a corresponding one of the two opposite ends of the chain wheel axle to fasten the two loops of the pulling member and the locking member.

3. The chain wheel locking device as claimed in claim 1, wherein the pulling member and the locking member respectively include a loop and a shaft outwardly extending from the loop, each loop adapted to be sleeved on the chain wheel axle and each shaft has a threaded portion formed on a free end thereof, a first nut screwed onto the threaded portion of the shaft of the pulling member after the shaft of the pulling member extends through a first engager, a second nut screwed onto the threaded portion of the shaft of the locking member after the shaft of the locking member extends through a second engager, a nut adapted to be screwed onto a corresponding one of the two opposite ends of the chain wheel axle to fasten the two loops of the pulling member and the locking member.

4. The chain wheel locking device as claimed in claim 2, wherein the engager has a U-shaped cross-section for partially receiving a distal edge of a corresponding one of the two supports.

5. The chain wheel locking device as claimed in claim 3, wherein the first engager and the second engager respectively have a U-shaped cross-section for partially receiving a distal edge of a corresponding one of the two supports.

6. The chain wheel locking device as claimed in claim 1, wherein each slot has two opposite sides each having a bore defined in a corresponding one of the two supports, the pulling member including a loop and a shaft outwardly extending from the loop, wherein the loop is adapted to be sleeved on the chain wheel axle and the shaft has a threaded portion formed on a free end thereof, a first nut screwed onto the threaded portion of the shaft of the pulling member after the shaft of the pulling member extends through an engager, the locking member including a through hole defined therein and the chain wheel axle extending through the through hole, the locking member having two opposite ends each having an insertion extending therefrom, wherein each insertion is inserted into a corresponding one of the two bores and a nut is screwed onto the chain wheel axle to tightly position the locking member such that the locking member does not move relative to the support.

* * * * *